US005085934A

United States Patent [19]

Hotta et al.

[11] Patent Number: 5,085,934

[45] Date of Patent: * Feb. 4, 1992

[54] REVERSIBLE THERMOSENSITIVE RECORDING MATERIAL

[75] Inventors: Yoshihiko Hotta, Mishima; Syoji Maruyama, Yokohama; Makoto Kawaguchi, Shizuoka, all of Japan

[73] Assignee: Ricoh Company, Ltd., Tokyo, Japan

[ * ] Notice: The portion of the term of this patent subsequent to Apr. 17, 2007 has been disclaimed.

[21] Appl. No.: 519,028

[22] Filed: May 4, 1990

[30] Foreign Application Priority Data

May 31, 1989 [JP] Japan ..... 1-140109

[51] Int. Cl.[5] ..... B41M 5/26

[52] U.S. Cl. ..... 428/335; 428/195; 428/336; 428/423.1; 428/447; 428/474.4; 428/480; 428/500; 428/522; 428/913; 428/914

[58] Field of Search ..... 428/195, 484, 488.1, 428/913, 914, 411.1, 327, 335, 336, 447, 474.4, 480, 521, 522, 423.1, 500; 525/301.5, 376, 378, 386, 428, 437, 445; 346/135.1

[56] References Cited

U.S. PATENT DOCUMENTS 4,917,948 4/1990 Hotta et al. ..... 428/335

*Primary Examiner*—Pamela R. Schwartz

*Attorney, Agent, or Firm*—Oblon, Spivak, McClelland, Maier & Neustadt

[57] ABSTRACT

A reversible thermosensitive recording material comprising (a) a support, and (b) a reversible thermosensitive recording layer formed thereon, which comprises a matrix resin, and low-molecular-weight components of (i) at least one higher fatty acid having 16 or more carbon atoms and (ii) at least one aliphatic saturated dicarboxylic acid having 20 or more carbon atoms, dispersed in the matrix resin, with the ratio by weight of the amount of the higher fatty acid to the amount of the aliphatic saturated dicarboxylic acid being in the range of 95:5 to 50:50.

11 Claims, 1 Drawing Sheet

FIGURE
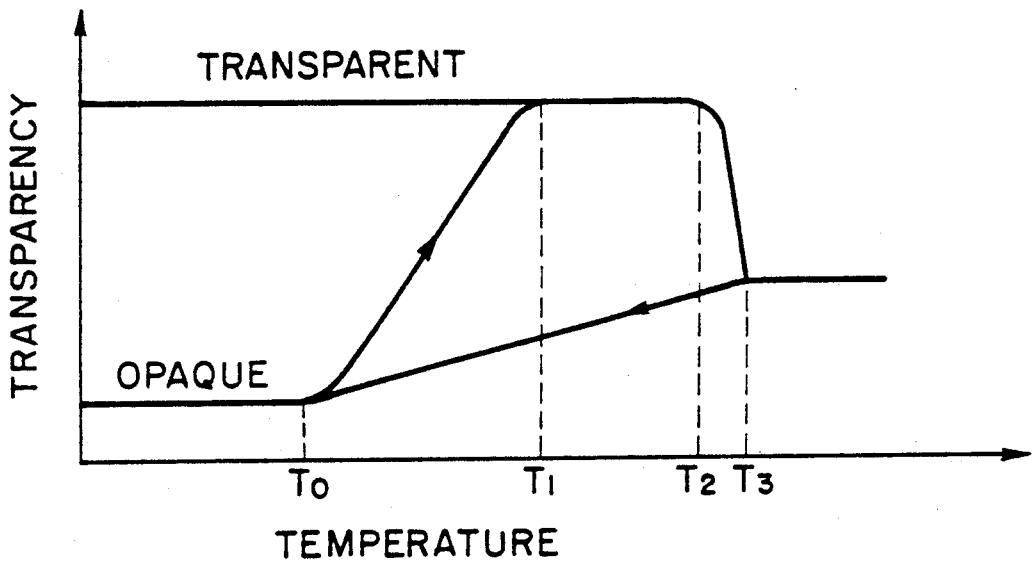

REVERSIBLE THERMOSENSITIVE RECORDING MATERIAL

BACKGROUND OF THE INVENTION

1. Field of the Invention

The present invention relates to a reversible thermosensitive recording material capable of recording and erasing images by utilizing its property that the transparency changes reversibly between a transparent state and an opaque state depending upon the temperature thereof.

2. Discussion of Background

Hitherto, various reversible thermosensitive recording materials have been proposed, and, among them, the most typical one is a thermosensitive recording material comprising a thermosensitive recording layer which contains a matrix resin such as a polyvinyl chloride resin, and an organic low-molecular-weight material such as a higher fatty acid dispersed therein as disclosed in Japanese Laid-Open Patent Applications 54-119377 and 55-154198.

In the reversible thermosensitive recording material of this type, the property of the thermosensitive recording layer that its transparency reversibly changes depending on the temperature is utilized for recording and erasing images in the recording layer. However, the state of the thermosensitive recording layer is changed from opaque to transparent in a narrow temperature range of 2° to 4° C. It is therefore difficult to control the temperature at which a partially opaque recording material is entirely changed to transparent, or an entirely opaque recording material is made partially transparent to form transparent images therein.

In order to eliminate the above shortcoming in the prior art, the inventors of the present invention have proposed a reversible thermosensitive recording material comprising a thermosensitive recording layer which contains a specific low-molecular-weight material and a material which easily constitutes a eutectic mixture with the low-molecular-weight material as disclosed in Japanese Laid-Open Patent Applications 63-39378 and 63-130380. The state of this thermosensitive recording layer changes from opaque to transparent in a temperature range wider than the above-mentioned range. However, the temperature range has been extended to a relatively low temperature region, so that images formed in the recording material occasionally disappear when the recording material is preserved at temperatures between 50° and 60° C.

Under these circumstances, the inventors of the present invention further found that the temperature range in which the state of the thermosensitive layer is changed from opaque to transparent can be extended to a high temperature region by incorporating thereinto an aliphatic dicarboxylic acid having a high melting point as disclosed in Japanese Laid-Open Patent Application 2-1363.

Thus, the temperature range can be successfully extended, and at the same time the preservability of the recorded images can also be improved. However, in the case where a protective layer is provided on the thermosensitive recording layer, the transparency of the thermosensitive recording material is deteriorated, possibly due to exudation of the aliphatic dicarboxylic acid contained in the recording layer to the protective layer.

SUMMARY OF THE INVENTION

Accordingly, an object of the present invention is to provide a reversible thermosensitive recording material free from the above drawbacks in the prior art, capable of yielding clear images having high preservability with high contrast.

Another object of the present invention is to provide a reversible thermosensitive recording material having a wide temperature range in which the state of a thermosensitive recording layer reversibly changes between opaque and transparent.

The above objects of the present invention can be achieved by a reversible thermosensitive recording material comprising (a) a support, and (b) a reversible thermosensitive sensitive recording layer formed thereon, which comprises a matrix resin, and organic low-molecular-weight components of (i) at least one higher fatty acid having 16 or more carbon atoms and (ii) at least one aliphatic saturated dicarboxylic acid having 20 or more carbon atoms, dispersed in the matrix resin, with the ratio by weight of the amount of the higher fatty acid to the amount of the aliphatic saturated dicarboxylic acid being in the range of 95:5 to 50:50.

BRIEF DESCRIPTION OF THE DRAWING

A more complete appreciation of the invention and many of the attendant advantages thereof will be readily obtained as the same becomes understood by reference to the following detailed description when considered in connection with the accompanying drawing, wherein:

the sole FIGURE is a diagram showing the principle of the formation and erasion of images in a reversible thermosensitive recording material according to the present invention.

DETAILED DESCRIPTION OF THE PREFERRED EMBODIMENTS

The formation and erasion of images in the reversible thermosensitive recording material according to the present invention are carried out by utilizing the property of the thermosensitive recording layer that its transparency reversibly changes depending on the temperature. The inventors of the present invention have found that the thermosensitive recording layer comprising specific materials changes its state from opaque to transparent at high temperatures in a wide range compared with conventional thermosensitive recording layer. In addition, it has been found that even when a protective layer is formed on the thermosensitive recording layer, the transparency of the thermosensitive recording material is not deteriorated. The present invention has been accomplished on the basis of the above findings.

Referring now to the accompanying FIGURE, the present invention will be described in detail.

A transparent state and a milky white opaque state of the reversible thermosensitive recording material according to the present invention are considered to be caused by the difference in size of the crystals of the higher fatty acid and the aliphatic saturated dicarboxylic acid (which are collectively referred to as the organic low-molecular-weight components), which are dispersed in the form of particles in a matrix resin.

In the transparent state, the organic low-molecular-weight components exist as relatively large crystals, possibly most of them being single crystals, so that the light which enters the crystals from one side passes therethrough to the opposite side without being scattered. The reversible thermosensitive recording material thus appears transparent.

In the milky white opaque state, the organic low-molecular-weight components exist as polycrystals consisting of numerous fine crystals with the crystallographic axes directed in different directions from one another, so that the light which enters the recording layer is scattered many times. As a result, the recording layer becomes opaque in a milky white color.

The FIGURE shows how the transparency of the recording layer changes depending upon the temperature thereof. As shown in this FIGURE, for instance, when the thermosensitive recording layer is initially in a milky white opaque state at room temperature $T_0$ or below, this opaque state will be referred to as a maximum opaque state. When the recording material is heated to temperature $T_1$, the recording layer becomes transparent. This transparent state is maintained even if the temperature is further heated to temperature $T_2$. Thus, the recording material reaches a maximum transparent state at temperature $T_1$, and the maximum transparent state is maintained until the temperature of the recording material reaches $T_2$. Even if the recording material in the maximum transparent state is cooled to the room temperature $T_0$ or below, the maximum transparent state is kept unchanged. It is considered that this is because the organic low-molecular-weight components change their state from a polycrystalline state to a single crystalline state via a semi-melted state during the above-mentioned heating and cooling steps.

When the recording material in the maximum transparent state is further heated to temperature $T_3$, it reaches a semitransparent state which is between the maximum transparent state and the maximum opaque state. When the recording material in the semitransparent state is cooled to the room temperature $T_0$ or below, it returns to the original maximum opaque state without going through a transparent state. It is considered that this is because the organic low-molecular-weight components are melted when heated to temperature $T_3$ or above, and are crystallized to yield polycrystals when cooled to temperature $T_0$ or below. If the recording material in the milky white opaque state is heated to temperatures between $T_0$ and $T_1$ and then cooled to a temperature below $T_0$, the recording material reaches an intermediate semitransparent state between the transparent and the milky white opaque states.

When the recording material in the transparent state at room temperature $T_0$ is again heated to temperature $T_3$ or above, and then cooled to room temperature $T_0$, the recording material returns to the maximum white opaque state. Thus, the reversible thermosensitive recording material according to the present invention can take a milky white maximum opaque state, a maximum transparent state, and an intermediate semitransparent state between the aforementioned two states at room temperature.

Therefore, by selectively heating the thermosensitive recording material, white opaque images can be formed in a thermosensitive recording layer which is in a transparent state and transparent images can be formed in a thermosensitive recording layer which is in a milky white opaque state. The images formed in the recording layer can be erased with application of heat. Such formation and erasion of images in the recording layer can be reversely repeated as desired.

When a colored sheet or board, for instance, a black paper, is placed behind the white image bearing reversible thermosensitive recording material in contact therewith, milky white images on a colored (for instance, black) background can be obtained. When this white image bearing reversible thermosensitive recording material is employed as an original in an overhead projector, the milky white images are projected on a screen with the dark images corresponding to the white images with the light background corresponding to the transparent background of the recording material.

A reversible thermosensitive recording material in which formation and erasion of images can be reversely performed in accordance with the above-outlined process at relatively high temperatures in an extended range, and which can maintain a high transparency even when a protective layer is provided on the thermosensitive recording layer can be obtained by employing low-molecular-weight components of at least one higher fatty acid having 16 or more carbon atoms, and at least one aliphatic saturated dicarboxylic acid having 20 or more carbon atoms, which has a melting point higher than that of the higher fatty acid and cannot be easily dissolved in a solvent.

This is because the eutectic point of the higher fatty acid and the aliphatic saturated dicarboxylic acid is higher than the melting point of the higher fatty acid. Moreover, the aliphatic saturated dicarboxylic acid having 20 or more carbon atoms is not easily dissolved in a solvent which is used when a protective layer is formed on the thermosensitive recording layer, so that it does not exude to the surface of the thermosensitive recording material.

The reversible thermosensitive recording material according to the present invention can be prepared by forming a reversible thermosensitive recording layer on a support.

For the preparation of the reversible thermosensitive recording layer, the following solution or dispersion is first prepared: (1) a solution of a matrix resin, and organic low-molecular-weight components of a higher fatty acid having 16 or more carbon atoms and an aliphatic saturated dicarboxylic acid having 20 or more carbon atoms dissolved in a solvent; or (2) a dispersion of the organic low-molecular-weight components in a solution of a matrix resin dissolved in a solvent in which at least one of the organic low-molecular-weight components cannot be dissolved.

The above solution or dispersion is coated onto a support such as a plastic film, a glass plate, or a metal plate, and then dried, whereby a reversible thermosensitive recording layer is formed on the support.

The solvent for use in the solution or dispersion for forming the reversible thermosensitive recording layer is selected out of a variety of solvents depending upon the kind of the organic low-molecular-weight components and the matrix resin employed; for instance, tetrahydrofuran, methyl ethyl ketone, methyl isobutyl ketone, chloroform, carbon tetrachloride, ethanol, toluene or benzene is preferably employed. Not only in the case where the above-mentioned dispersion (2) is employed, but also in the case of the solution (1), the organic low-molecular-weight components exist in the form of fine crystals dispersed in the reversible thermosensitive recording layer.

The matrix resin employed in the reversible thermosensitive recording layer not only holds the organic low-molecular-weight components in a uniformly dispersed state, but also has a significant effect on the transparency of the recording layer when the recording layer is in a maximum transparent state. It is therefore preferable that the matrix resin have high mechanical stability and excellent film-forming properties. Preferable examples of the matrix resin are polyvinyl chloride; vinyl chloride copolymers such as a vinyl chloride - vinyl acetate copolymer, a vinyl chloride - vinyl acetate - vinyl alcohol copolymer, a vinyl chloride - vinyl acetate - maleic acid copolymer, and a vinyl chloride - acrylate copolymer; polyvinylidene chloride; vinylidene chloride copolymers such as a vinylidene chloride - vinyl chloride copolymer, and a vinylidene chloride - acrylonitrile copolymer, polyester; polymide; polyacrylate; polymethacrylate; an acrylate - methacrylate copolymer; and a silicone resin. The above resins may be used either alone or in combination.

The organic low-molecular-weight components for use in the present invention are appropriately selected in accordance with each of the desired temperature ranges, $T_0$ to $T_1$, $T_1$ to $T_2$, and $T_2$ to $T_3$.

A higher fatty acid having 16 or more carbon atoms is employed as one of the low-molecular-weight components.

Specific examples of the higher fatty acid are palmitic acid, margaric acid, stearic acid, nonadecanoic acid, eicosanic acid, heneicosanic acid, behenic acid, lignoceric acid, pentacosanoic acid, cerotic acid, heptacosanoic acid, montanic acid, nonacosanoic acid, melissic acid, 2-hexadecenoic acid, trans-3-hexadecenoic acid, 2-heptadecenoic acid, trans-2-octadecenoic acid, cis-2-octadecanoic acid, trans-4-octadecenoic acid, cis-6-octadecenoic acid, elaidic acid, trans-11-octadecenoic acid, trans-11-eicosenoic acid, erucic acid, brassidic acid, selacholeic acid, transselacholeic acid, trans-8,trans-10-octadecadienoic acid, linoelaidic acid, α-eleostearic acid, β-eleostearic acid, pseudoeleostearic acid, and 12,20-heneicosadienoic acid. The above fatty acids may be employed either alone or in combination.

The aliphatic saturated dicarboxylic acids of the formula $HOOC(COOH_2)_{n-2}COOH$ ($n \geqq 2$), having 20 or more carbon atoms as shown in Table 1 are used as the other organic low-molecular-weight component.

TABLE 1

| Number of Carbon Atoms | Compound | Molecular Formula |
|---|---|---|
| 20 | Eicosanedioic acid | $(CH_2)_{18}(COOH)_2$ |
| 21 | Heneicosanedioic acid | $(CH_2)_{19}(COOH)_2$ |
| 22 | Docosanedioic acid | $(CH_2)_{20}(COOH)_2$ |
| 23 | Tricosanedioic acid | $(CH_2)_{21}(COOH)_2$ |
| 24 | Tetracosanedioic acid | $(CH_2)_{22}(COOH)_2$ |
| 25 | Pentacosanedioic acid | $(CH_2)_{23}(COOH)_2$ |
| 26 | Hexacosanedioic acid | $(CH_2)_{24}(COOH)_2$ |

In the present invention, it is preferable that the ratio by weight of the higher fatty acid to the aliphatic saturated dicarboxylic acid be 95:5 to 50:50.

Furthermore, it is preferable that the ratio by weight of the total amount of the organic low-molecular-weight components of the higher fatty acid and the aliphatic saturated dicarboxylic acid to the previously mentioned matrix resin be in the range of 2:1 to 1:16, more preferably in the range of 1:1 to 1:3.

It is preferable that the thickness of the thermosensitive recording layer be in the range of 1 μm to 30 μm for obtaining high thermosensitivity and images with high contrast.

In order to maintain the temperature range in which the maximum transparent state is maintained even when the reversible thermosensitive recording material is used in repetition over an extended period of time, the known plasticizer may be incorporated into the thermosensitive recording layer. Examples of the plasticizer include tributyl phosphate, tri-2-ethylhexyl phosphate, triphenyl phosphate, tricresyl phosphate, butyl oleate, dimethyl phthalate, diethyl phthalate, dibutyl phthalate, diheptyl phthalate, di-n-octyl phthalate, di-2-ethylhexyl phthalate, diisononyl phthalate, dioctyldecyl phthalate, diisodecyl phthalate, butylbenzyl phthalate, dibutyl adipate, di-n-hexyl adipate, di-2-ethylhexyl adipate, di-2-ethylhexyl azelate, dibutyl cebacate, di-2-ethylhexyl cebacate, diethylene glycol dibenzoate, tri-ethylene glycol-2-ethyl butylate, methyl acetylricinoleate, butyl acetylricinoleate, butylphthalyl butylglycolate, and tributyl acetylcitrate.

The ratio by weight of the total amount of the organic low-molecular-weight components to the amount of any of the above plasticizers is preferably in the range of 1:0.01 to 1:0.8.

A protective layer may be provided on the surface of the thermosensitive recording layer, if necessary. Examples of the material for the protective layer include an urethane acrylate based ultraviolet-curing resin, a silicone rubber, a silicone resin as disclosed in Japanese Laid-Open Patent Application 63-221087, finely-divided particles of a polysiloxane grafted polymer as disclosed in Japanese Patent Application 62-152550 along with a resin, and a polyamide resin.

The above material is dissolved in a solvent, and the resulting solution is coated onto the surface of the thermosensitive recording layer. In this case, it is preferable that the matrix resin and the low-molecular-weight components contained in the thermosensitive recording layer cannot be dissolved in the solvent.

Examples of such a solvent include n-hexane, methyl alcohol, ethyl alcohol, and isopropyl alcohol. Of these, an alcohol is preferred from the economical point of view.

An intermediate layer may be formed between the thermosensitive recording layer and the protective layer, if necessary.

Other features of this invention will become apparent in the course of the following description of exemplary embodiments, which are given for illustration of the invention and are not intended to be limiting thereof.

EXAMPLE 1

A solution having the following formulation was coated onto the surface of an Al-deposited polyester film having a thickness of approximately 50 μm (made by Toray Industries, Inc.) by a wire bar, and then dried with application of heat thereto to form a thermosensitive recording layer having a thickness of approximately 5 μm.

| | Parts by weight |
|---|---|
| Behenic acid | 95 |
| Eicosanedioic acid | 5 |
| Vinyl chloride - vinyl acetate copolymer | 250 |
| Di(2-ethylhexyl) phthalate | 30 |
| Tetrahydrofuran | 2000 |

A solution consisting of 10 parts by weight of a polyamide resin "CM8000" (Trademark, made by Toray Industries, Inc.) and 90 parts by weight of methyl alcohol was coated onto the surface of the above-formed thermosensitive recording layer by a wire bar, and then dired with application of heat thereto, thereby forming an intermediate layer having a thickness of approximately 1 μm.

A butyl acetate solution of an urethane acrylate based ultraviolet-curing resin "Unideck 17-824-9" (Trademark, made by Dainippon Ink & Chemicals, Incorporated) was coated onto the intermediate layer by a wire bar, and then dried with application of heat thereto. Thereafter, an ultraviolet ray was applied to the layer thus formed by an ultraviolet lump of 80 W/cm for 5 seconds, thereby forming a protective layer having a thickness of approximately 2 μm.

Thus, reversible thermosensitive recording material No. 1 according to the present invention was prepared.

EXAMPLE 2

The procedure in Example 1 was repeated except that the solution used in Example 1 for forming the thermosensitive recording layer was replaced by a solution having the following formulation, whereby reversible thermosensitive recording material No. 2 according to the present invention was prepared.

| | Parts by weight |
|---|---|
| Behenic acid | 80 |
| Eicosanedioic acid | 20 |
| Vinyl chloride - vinyl acetate copolymer | 250 |
| Di(2-ethylhexyl) phthalate | 30 |
| Tetrahydrofuran | 2000 |

EXAMPLE 3

The procedure in Example 1 was repeated except that the solution used in Example 1 for forming the theremosensitive recording layer was replaced by a solution having the following formulation, whereby reversible theremosensitive recording material No. 3 according to the present invention was prepared.

| | Parts by weight |
|---|---|
| Behenic acid | 50 |
| Eicosanedioic acid | 50 |
| Vinyl chloride - vinyl acetate copolymer | 250 |
| Di(2-ethylhexyl) phthalate | 30 |
| Tetrahydrofuran | 2000 |

EXAMPLE 4

The procedure in Example 1 was repeated except that the solution used in Example 1 for forming the thermosensitive recording layer was replaced by a solution having the following formulation, whereby reversible thermosensitive recording material No. 4 according to the present invention was prepared.

| | Parts by weight |
|---|---|
| Stearic acid | 95 |
| Docosanedioic acid | 5 |
| Saturated polyester resin | 250 |
| Di-n-butyl phthalate | 30 |
| Tetrahydrofuran | 1500 |

EXAMPLE 5

The procedure in Example 1 was repeated except that the solution used in Example 1 for forming the thermosensitive recording layer was replaced by a solution having the following formulation, whereby reversible theremosensitive recording material No. 5 according to the present invention was prepared.

| | Parts by weight |
|---|---|
| Stearic acid | 80 |
| Docosanedioic acid | 20 |
| Saturated polyester resin | 250 |
| Di-n-butyl phthalate | 30 |
| Tetrahydrofuran | 1500 |

EXAMPLE 6

The procedure in Example 1 was repeated except that the solution used in Example 1 for forming the thermosensitive recording layer was replaced by a solution having the following formulation, whereby reversible thermosensitive recording material No. 6 according to the present invention was prepared.

| | Parts by weight |
|---|---|
| Stearic acid | 50 |
| Docosanedioic acid | 50 |
| Saturated polyester resin | 250 |
| Di-n-butyl phthalate | 30 |
| Tetrahydrofuran | 1500 |

EXAMPLE 7

The procedure in Example 1 was repeated except that the solution used in Example 1 for forming the thermosensitive recording layer was replaced by a solution having the following formulation, whereby reversible thermosensitive recording material No. 7 according to the present invention was prepared.

| | Parts by weight |
|---|---|
| Lignoceric acid | 95 |
| Tetracosanedioic acid | 5 |
| Vinyl chloride - vinyl acetate-phosphoric ester copolymer, "Denka Vinyl #1000P" (Trademark, made by Denki Kagaku Kogyo K.K.) | 250 |
| Di-n-heptyl phthalate | 30 |
| Tetrahydrofuran | 1500 |

EXAMPLE 8

The procedure in Example 1 was repeated except that the solution used in Example 1 for forming the thermosensitive recording layer was replaced by a solution having the following formulation, whereby reversible thermosensitive recording material No. 8 according to the present invention was prepared.

| | Parts by weight |
|---|---|
| Lignoceric acid | 80 |
| Tetracosanedioic acid | 20 |
| Vinyl chloride - vinyl acetate-phosphoric ester copolymer, "Denka Vinyl #1000P" (Trademark, made by Denki Kagaku Kogyo K.K.) | 250 |

-continued

| | Parts by weight |
|---|---|
| Di-n-heptyl phthalate | 30 |
| Tetrahydrofuran | 1500 |

EXAMPLE 9

The procedure in Example 1 was repeated except that the solution used in Example 1 for forming the thermosensitive recording layer was replaced by a solution having the following formulation, whereby reversible thermosensitive recording material No. 9 according to the present invention was prepared.

| | Parts by weight |
|---|---|
| Lignoceric acid | 50 |
| Tetracosanedioic acid | 50 |
| Vinyl chloride - vinyl acetate-phosphoric ester copolymer, "Denka Vinyl #1000P" (Trademark, made by Denki Kagaku Kogyo K.K.) | 250 |
| Di-n-heptyl phthalate | 30 |
| Tetrahydrofuran | 1500 |

COMPARATIVE EXAMPLE 1

The procedure in Example 1 was repeated except that the solution used in Example 1 for forming the thermosensitive recording layer was replaced by a solution having the following formulation, whereby comparative reversible thermosensitive recording material No. 1 was prepared.

| | Parts by weight |
|---|---|
| Behenic acid | 98 |
| Eicosanedioic acid | 2 |
| Vinyl chloride - vinyl acetate copolymer | 250 |
| Di(2-ethylhexyl) phthalate | 30 |
| Tetrahydrofuran | 2000 |

COMPARATIVE EXAMPLE 2

The procedure in Example 1 was repeated except that the solution used in Example 1 for forming the thermosensitive recording layer was replaced by a solution having the following formulation, whereby comparative reversible thermosensitive recording material No. 2 was prepared.

| | Parts by weight |
|---|---|
| Behenic acid | 40 |
| Eicosanedioic acid | 60 |
| Vinyl chloride - vinyl acetate copolymer | 250 |
| Di(2-ethylhexyl) phthalate | 30 |
| Tetrahydrofuran | 2000 |

COMPARATIVE EXAMPLE 3

The procedure in Example 1 was repeated except that the solution used in Example 1 for forming the thermosensitive recording layer was replaced by a solution having the following formulation, whereby comparative reversible thermosensitive recording material No. 3 was prepared.

| | Parts by weight |
|---|---|
| Stearic acid | 98 |
| Docosanedioic acid | 2 |
| Saturated polyester resin | 250 |
| Di-n-butyl phthalate | 30 |
| Tetrahydrofuran | 1500 |

COMPARATIVE EXAMPLE 4

The Procedure in Example 1 was repeated except that the solution used in Example 1 for forming the thermosensitive recording layer was replaced by a solution having the following formulation, whereby comparative reversible thermosensitive recording material No. 4 was prepared.

| | Parts by weight |
|---|---|
| Stearic acid | 40 |
| Docosanedioic acid | 60 |
| Saturated polyester resin | 250 |
| Di-n-butyl phthalate | 30 |
| Tetrahydrofuran | 1500 |

COMPARATIVE EXAMPLE 5

The procedure in Example 1 was repeated except that the solution used in Example 1 for forming the thermosensitive recording layer was replaced by a solution having the following formulation, whereby comparative reversible thermosensitive recording material No. 5 was prepared.

| | Parts by weight |
|---|---|
| Lignoceric acid | 98 |
| Tetracosanedioic acid | 2 |
| Vinyl chloride - vinyl acetate-phosphoric ester copolymer, "Denka Vinyl #1000P" (Trademark, made by Denki Kagaku Kogyo K.K.) | 250 |
| Di-n-heptyl phthalate | 30 |
| Tetrahydrofuran | 1500 |

COMPARATIVE EXAMPLE 6

The procedure in Example 1 was repeated except that the solution used in Example 1 for forming the thermosensitive recording layer was replaced by a solution having the following formulation, whereby comparative reversible thermosensitive recording material No. 6 was prepared.

| | Parts by weight |
|---|---|
| Lignoceric acid | 40 |
| Tetracosanedioic acid | 60 |
| Vinyl chloride - vinyl acetate-phosphoric ester copolymer, "Denka Vinyl #1000P" (Trademark, made by Denki Kagaku Kogyo K.K.) | 250 |
| Di-n-heptyl phthalate | 30 |
| Tetrahydrofuran | 1500 |

COMPARATIVE EXAMPLE 7

The procedure in Example 1 was repeated except that the solution used in Example 1 for forming the thermosensitive recording layer was replaced by a solution having the following formulation, whereby comparative reversible thermosensitive recording material No. 7 was prepared.

| | Parts by weight |
|---|---|
| Behenic acid | 80 |
| Octadecanedioic acid | 20 |
| Vinyl chloride - vinyl acetate copolymer | 250 |
| Di(2-ethylhexyl) phthalate | 30 |
| Tetrahydrofuran | 2000 |

COMPARATIVE EXAMPLE 8

The procedure in Example 1 was repeated except that the solution used in Example 1 for forming the thermosensitive recording layer was replaced by a solution having the following formulation, whereby comparative reversible thermosensitive recording material No. 8 was prepared.

| | Parts by weight |
|---|---|
| Stearic acid | 80 |
| Dodecanedioic acid | 20 |
| Saturated polyester resin | 250 |
| Di-n-butyl phthalate | 30 |
| Tetrahydrofuran | 1500 |

The thus obtained reversible thermosensitive recording materials Nos. 1 to 9 according to the present invention and comparative reversible thermosensitive recording materials Nos. 1 to 8 were in a milky white opaque state.

Each of the recording materials was heated from 65° C. to 120 C. stepwise with a temperature interval of 1°C., and the reflection density of each sample at each temperature was measured by a McBeth densitometer RD 514.

The temperatures at which the reflection density exceeded 1.0 were recorded, which temperatures are referred to as "transparency temperature" for convenience' sake.

Each of the recording materials was evaluated in terms of the transparency temperature, the range of the transparency temperature, which is referred to as "transparency temperature range" for convenience' sake, the reflection density at the maximum transparent state, which was measured at temperatures in the transparency temperature range, and the reflection density at the maximum opaque state, which was measured at room temperature. The results are shown in Table 2.

TABLE 2

| Sample | A | B | C | D |
|---|---|---|---|---|
| No. 1 | 71–77 | 7 | 1.77 | 0.31 |
| No. 2 | 70–83 | 14 | 1.78 | 0.34 |
| No. 3 | 73–92 | 20 | 1.80 | 0.40 |
| No. 4 | 63–69 | 7 | 1.80 | 0.33 |
| No. 5 | 62–72 | 11 | 1.80 | 0.34 |
| No. 6 | 65–80 | 16 | 1.81 | 0.41 |
| No. 7 | 76–81 | 6 | 1.82 | 0.34 |
| No. 8 | 76–84 | 9 | 1.83 | 0.35 |
| No. 9 | 77–90 | 14 | 1.83 | 0.42 |
| Comp. No. 1 | 74–77 | 4 | 1.77 | 0.30 |
| Comp. No. 2 | * | * | * | * |
| Comp. No. 3 | 64–66 | 3 | 1.76 | 0.29 |
| Comp. No. 4 | * | * | * | * |
| Comp. No. 5 | 77–79 | 3 | 1.77 | 0.30 |
| Comp. No. 6 | * | * | * | * |
| Comp. No. 7 | 71–78 | 8 | 1.38 | 0.34 |

TABLE 2-continued

| Sample | A | B | C | D |
|---|---|---|---|---|
| Comp. No. 8 | 69–74 | 6 | 1.12 | 0.33 |

In the above table,
A: Transparency temperature (°C.);
B: Transparency temperature range (°C.);
C: Reflection density at maximum transparent state;
D: Reflection density at maximum opaque state: and
*Impossible to conduct the measurement because no uniform film was formed.

As is clearly understood from the above-obtained data, the reversible thermosensitive recording materials according to the present invention comprising as the low-molecular-weight components at least one higher fatty acid having 16 or more carbon atoms and at least one aliphatic saturated dicarboxylic acid having 20 or more carbon atoms have high transparency temperatures and wide transparency temperature ranges.

In addition, the low-molecular-weight components are hardly dissolved in a solvent, so that the preservability of images recorded in the recording materials is greatly improved, and the transparency of the recording materials is not deteriorated even when a protective layer is formed on the surface of the recording materials.

What is claimed is:

1. A reversible thermosensitive recording material comprising:

(a) a support, and (b) a reversible thermosensitive recording layer formed thereon, which comprises a matrix resin, and low-molecular-weight components of (i) at least one higher fatty acid having 16 or more carbon atoms and (ii) at least one aliphatic saturated dicarboxylic acid having 20 or more carbon atoms, dispersed in said matrix resin, with the ratio by weight of the amount of said higher fatty acid to the amount of said aliphatic saturated dicarboxylic acid being in the range of 95:5 to 50:50.

2. The reversible thermosensitive recording material as claimed in claim 1, wherein the ratio by weight of the total amount of said higher fatty acid and said aliphatic saturated dicarboxylic acid to the amount of said matrix resin is in the range of 2:1 to 1:16.

3. The reversible thermosensitive recording material as claimed in claim 1, wherein said reversible thermosensitive recording layer has a thickness in the range of 1 μm to 30 μm.

4. The reversible thermosensitive recording material as claimed in claim 1, wherein said matrix resin is selected from the group consisting of polyvinyl chloride, a vinyl chloride - vinyl acetate copolymer, a vinyl chloride - vinyl acetate - vinyl alcohol copolymer, a vinyl chloride - vinyl acetate - maleic acid copolymer, a vinyl chloride - acrylate copolymer, polyvinylidene chloride, a vinylidene chloride-vinyl chloride copolymer, a vinylidene chloride - acrylo-nitrile copolymer, polyester, polyamide, polyacrylate, polymethacrylate, an acrylate - methacrylate copolymer, and a silicone resin.

5. The reversible thermosensitive recording material as claimed in claim 1, wherein said higher fatty acid is selected from the group consisting of palmitic acid, margaric acid, stearic acid, nonadecanoic acid, eicosanic acid, heneicosanic acid, behenic acid, lignoceric acid, pentacosanoic acid, cerotic acid, heptacosanoic acid, montanic acid, nonacosanoic acid, melissic acid, 2-hexadecenoic acid, trans-3-hexadecenoic acid, 2-heptadecenoic acid, trans-2-octadecenoic acid, cis-2-octadecanoic acid, trans-4-octadecenoic acid, cis-6-octadecenoic acid, elaidic acid, trans-11-octadecenoic acid, trans-11-eicosenoic acid, erucic acid, brassidic acid, selacholeic acid, trans-selacholeic acid, trans-8,trans-10-octadecadienoic acid, linoelaidic acid, α-eleostearic acid, 8-eleostearic acid, pseudoeleostearic acid, and 12,20-heneicosadienoic acid.

6. The reversible thermosensitive recording material as claimed in claim 1, wherein said aliphatic saturated dicarboxylic acid has the formula of $HOOC(CH_2)_n$-2COOH, wherein n is an integer of 20 or more.

7. The reversible thermosensitive recording material as claimed in claim 1, wherein said aliphatic saturated dicarboxylic acid is selected from the group consisting of eicosanedloic acid, heneicosanedoic acid, docosanedioic acid, tricosanedioic acid, tetracosanedioic acid, pentacosanedioic acid and hexacosanedioic acid.

8. The reversible thermosensitive recording material as claimed in claim 1, wherein said reversible thermosensitive recording layer further comprises a plasticizer in such an amount that the ratio by weight of the total amount of said higher fatty acid and said aliphatic saturated dicarboxylic acid to the amount of said plasticizer in the range of 1:0.01 to 1:0.8.

9. The reversible thermosensitive recording material as claimed in claim 8, wherein said plasticizer is selected from the group consisting of tributyl phosphate, tri-2-ethylhexyl phosphate, triphenyl phosphate, tricresyl phosphate, butyl oleate, dimethyl phthalate, diethyl phthalate, dibutyl phthalate, diheptyl phthalate, di-n-octyl phthalate, di-2-ethylhexyl phthalate, diisononyl phthalate, dioctyldecyl phthalate, diisodecyl phthalate, butylbenzyl phthalate, dibutyl adipate, di-n-hexyl adipate, di-2-ethyl-hexyl adipate, di-2-ethylhexyl azelate, dibutyl cebacate, di-2-ethylhexyl cebacate, diethylene glycol dibenzoate, triethylene glycol-2-ethyl butylate, methyl acetylricinoleate, butyl acetylricinoleate, butylphthalyl butylglycolate, and tributyl acetylcitrate.

10. The reversible thermosensitive recording material as claimed in claim 1, further comprising a protective layer formed on said reversible thermosensitive recording layer.

11. The reversible thermosensitive recording material as claimed in claim 10, wherein said protective layer is made from a material selected from the group consisting of an urethane acrylate based ultraviolet-curing resin, a silicone rubber, a silicone resin, a polysiloxane grafted polymer, and a polyamide resin.

* * * * *

UNITED STATES PATENT AND TRADEMARK OFFICE

CERTIFICATE OF CORRECTION

PATENT NO. : 5,085,934

DATED : FEBRUARY 4, 1992

INVENTOR(S) : YOSHIHIKO HOTTA ET AL

It is certified that error appears in the above-identified patent and that said Letters Patent is hereby corrected as shown below:

Column 2, line 16, after "thermosensitive", delete "sensitive".

Column 5, line 36, change "pseudoeleostearlc" to --pseudoeleostearic--;
line 40, change "$HOOC(COOH_2)_{n-2}COOH$" to --$HOOC(CH_2)_{n-2}COOH$--.

Column 13, Claim 5, line 6, change "8-eleostearic acid" to --β-eleostearic acid--;
Claim 6, lines 10-11, change "$HOOC(CH_2)_{N-}2COOH$" to --$HOOC(CH_2)_{n-2}COOH$--.

Column 14, Claim 11, line 22, after "acrylate", delete "based".

Signed and Sealed this

Twentieth Day of July, 1993

*Attest:*

*Attesting Officer*

Michael K. Kirk

MICHAEL K. KIRK

*Acting Commissioner of Patents and Trademarks*